US011457690B2

(12) United States Patent
Edge

(10) Patent No.: US 11,457,690 B2
(45) Date of Patent: Oct. 4, 2022

(54) ADJUSTABLE ARCH SUPPORT SYSTEM

(71) Applicant: Christopher Wayne Edge, Fuquay-Varina, NC (US)

(72) Inventor: Christopher Wayne Edge, Fuquay-Varina, NC (US)

(73) Assignee: Christopher Wayne Edge, Fuquay-Varina, NC (US)

( * ) Notice: Subject to any disclaimer, the term of this patent is extended or adjusted under 35 U.S.C. 154(b) by 125 days.

(21) Appl. No.: 16/991,574

(22) Filed: Aug. 12, 2020

(65) Prior Publication Data

US 2022/0047039 A1 Feb. 17, 2022

(51) Int. Cl.
*A43B 7/28* (2006.01)

(52) U.S. Cl.
CPC ..... *A43B 7/28* (2013.01)

(58) Field of Classification Search
CPC ..... A43B 7/28; A43B 7/142
USPC ..... 36/155
See application file for complete search history.

(56) References Cited

U.S. PATENT DOCUMENTS

| | | | | |
|---|---|---|---|---|
| 2,119,703 | A | 10/1936 | Copithorn | |
| 2,435,822 | A * | 2/1948 | Erickson | A43B 7/141 36/179 |
| 4,441,499 | A * | 4/1984 | Comparetto | A43B 7/1415 36/154 |
| 2,365,124 | A | 12/1994 | Uger | |
| 5,797,198 | A * | 8/1998 | Pomerantz | A43B 21/30 36/27 |
| 6,393,736 | B1 * | 5/2002 | Greer, Jr. | A61F 5/14 36/161 |
| 6,804,902 | B1 * | 10/2004 | McCracken | A61F 5/14 36/161 |
| 2008/0141562 | A1 | 6/2008 | Peveto | |
| 2009/0064536 | A1 * | 3/2009 | Klassen | A43B 21/26 36/35 R |
| 2017/0055629 | A1 | 3/2017 | Schickling | |
| 2017/0258176 | A1 | 9/2017 | Waatti et al. | |

* cited by examiner

*Primary Examiner* — Timothy K Trieu
(74) *Attorney, Agent, or Firm* — Katten Muchin Rosenman LLP

(57) ABSTRACT

Disclosed are systems, methods, and devices related to an adjustable arch support system. The adjustable arch support system enables selective adjustment of a component useful in supporting the arch. The system may comprise an insole, an outer shell positioned within the insole, and an inner shell positioned below the outer shell. The inner shell is attached to an adjustment system that controls an area of contact between the inner shell and the outer shell, where the adjustment system includes a gear and track system.

12 Claims, 8 Drawing Sheets

ADJUSTABLE ARCH SUPPORT SYSTEM

TECHNICAL FIELD

The field of the invention relates to footwear products, specifically to an adjustable arch support system.

BACKGROUND

In order to reduce the cost of manufacturing, the shoe industry has been moving toward standardized footwear products that are not customized to individual customers' needs. One issue associated with the standardized footwear is the lack of sufficient arch support. Problems associated with insufficient arch support include arch pain, heel spurs, plantar fasciitis, ill-fitting shoes, and a host of other problems.

In order to address the lack of customization during manufacture, several post-manufacturing approaches to develop customized arch support have arisen. One such example is over-the-counter arch supports. They are inserted within a standardized shoe and can help with providing some arch support. However, these arch supports are produced in standardized sizes, which makes it difficult to find an ideal fit for an individual's foot. This is because the shape of a person's arch is a function of the height of the arch, the foot stability, the width in the heel and forefoot, and other structural issues within the foot, all of which will vary from person to person. The activities and the type of shoe can also impact the type of arch support that will work best for each individual person. There is typically no way to adjust these over-the-counter arch supports, thus an individual may need different arch supports for different shoes and activities, thereby increasing the cost. Furthermore, arch supports are sold in pairs, so a person who has slight variations or differing orthotic requirements in each foot would be required to purchase two different pairs of arch supports, further increasing the cost of obtaining the correct support, if such support is even obtainable.

An even more expensive option is to have a pair of customized orthotics prepared that are molded to an individual's feet. Because of the cost associated with customized orthotics, an individual typically will only have one pair that he or she moves between shoes, which is time-consuming, annoying, and still may not function correctly if a person tends to wear multiple types of shoes for different activities. Furthermore, customized orthotics are typically made to be generally suitable for all activities, but are not specialized to give particular support for different types of athletic activities.

An additional issue with existing orthotics is that if the arch of the foot is not properly supported, a wearer may develop pain and or injury. For example, the wearer of the shoes or incorrectly fitted insole may exhibit none of the traditional symptoms of incorrect foot posture until presenting with pain, which may be in the knees or lower back. This source of discomfort may be hidden within the foot and the incorrectly fitted insole, leading to misdiagnosis and potential further injury. Of particular concern is a wearer with an existing injury that seems to resolve until using an ill-fitted shoe or insole, thereby exacerbating the injury and prolonging length of treatment for relief.

Thus, there is a need for an arch support that can be repeatedly adjusted to each individual foot, shoe type, and activity. Such a product would provide a degree of customization desired by consumers without the need to resort to a customized orthotic, and would also provide the ability to make ongoing adjustments after purchase.

BRIEF SUMMARY

In accordance with the purpose(s) of the currently disclosed subject matter, as embodied and broadly described herein, in one aspect relates to an adjustable arch support system which comprises an insole, an outer shell positioned within the insole, an inner shell positioned below the outer shell, and an adjustment system comprising a gear, wherein the inner shell is attached to the adjustment system and the adjustment system is configured such that it controls an area of contact between the inner shell and the outer shell. In some embodiments, the outer shell is conformable to the shape of the inner shell at least in the area of contact.

In another aspect, the adjustable arch support system may include a gear having a central axis that is held stationary within the inner sole and/or a track that is at least translationally mobile relative to the central axis of the gear. In some embodiments, rotation of the gear is configured to create a translational movement of the track. The adjustment system may further comprise an interlocking peg that engages with the gear when the interlocking peg is pressed toward the gear. The interlocking peg may disengage from the gear when the interlocking peg is not pressed toward the gear, thus preventing unwanted movement of the inner shell.

In another aspect, the subject matter disclosed herein relates to an adjustable arch support system comprising an inner shell and an adjustment system, wherein the adjustment system comprises a gear, a peg, an aperture, and a spring, wherein the peg comprises an interlocking shape that is configured to fit within a reciprocal interlocking shape located within an inner surface of the aperture. In an embodiment, the gear has between 4 and 16 teeth. In a further aspect, the adjustable arch support system comprising an inner shell and an adjustment system is positioned underneath or on top of the insole, such that the adjustable arch support system comprising an inner shell is not positioned within the insole.

In another aspect, the subject matter disclosed herein relates to a method for making the adjustable arch support system.

In another aspect, the subject matter disclosed herein relates to a method for using the adjustable arch support system. In an embodiment, the arch support system comprises an insole, an outer shell, an inner shell, and a gear, wherein the method comprises adjusting a position of the inner shell relative to the outer shell using the gear until the inner shell contacts the outer shell at a desired location. In some embodiments, the gear is coupled to a track and adjusting the position of the inner shell relative to the outer shell comprises rotating the gear.

These and other aspects are disclosed in further detail below.

BRIEF DESCRIPTION OF THE FIGURES

FIG. 2A shows the cross-sectional view, while FIG. 2B shows the arch support in a forward position, and FIG. 2C shows the arch support in a rear position.

DETAILED DESCRIPTION

Figure 1:
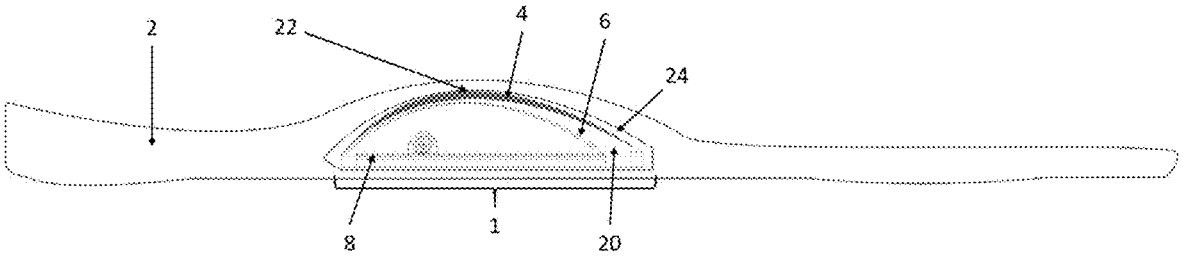
FIG. 1 shows a cross-sectional side view of the arch support and insole in accordance with an embodiment of the present invention.

As described herein, in embodiments, is an adjustable arch support system comprising an insole, an inner shell, an outer shell, and an adjustment gear, where the adjustable arch support system is intended to provide support for the arch of the wearer, regardless of the shoe, without extra customization or added expense.

The present invention can be understood more readily by reference to the following detailed description of the invention and the Examples included therein.

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. The subject matter should be understood by reference to appropriate portions of the entire specification of this patent, any or all drawings and each claim.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

While aspects of the present invention can be described and claimed in a particular statutory class, such as the system statutory class, this is for convenience only and one of skill in the art will understand that each aspect of the present invention can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is in no way intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

Definitions

Listed below are definitions of various terms used to describe this invention. These definitions apply to the terms as they are used throughout this specification, unless otherwise limited in specific instances, either individually or as part of a larger group.

As used in the specification and the appended claims, the singular forms "a," "an" and "the" include plural referents unless the context clearly dictates otherwise. Thus, for example, reference to "a bumper" or "a track" includes the possibility for there being two or more bumpers or tracks.

The term "or" is not to be construed as identifying mutually exclusive options. For example, the phrase "X contains A or B" can mean that X contains A and not B, X contains B and not A, or X contains both A and B. That is, the term "or" is used to mean "and/or" unless explicitly indicated to refer to alternatives only or the alternatives are mutually exclusive, although the disclosure may support a definition that refers to only alternatives and "and/or." As used herein "another" can mean at least a second or more.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units is also disclosed. For example, if 10 and 15 are disclosed, then 11, 12, 13, and 14 are also disclosed.

As used herein, the terms "optional" and "optionally" mean that the subsequently described event or circumstance can or cannot occur, and that the description includes instances where said event or circumstance occurs and instances where it does not.

As used herein, the term "arch" refers to the medial side plantar region of a foot located under at least the proximal portions of the first and second metatarsals, the medial and intermediate cuneiforms, and an anterior portion of the navicular. An arch may extend further forward, further toward the lateral side, and/or further rearward. The arch is typically described as either a high arch, normal or medium arch, or as a flat or low arch. These different types of arches have differing shapes and differing amounts of empty space between the foot and the base of the shoe.

As used herein, the term "shoe" is used to refer to an article intended for wear on a human foot. A shoe may or may not enclose the entire food of a wearer. For example, a shoe could be a sandal or other article that exposes large portions of a wearers foot.

For purposes of directions used to describe a shoe, foot, or insole, a forward direction is toward the toe. A rearward direction is toward the heel. An upward direction is away from the reference plane, and toward the top of the shoe or food. A downward direct is toward the reference plane, or toward the base of the shoe or sole of the foot.

Adjustable Arch Support

The described embodiments of the invention provide a repeatedly adjustable arch support for any type of footwear. While aspects of the adjustable arch support system are discussed for use with footwear, they are by no means so limited. Rather, embodiments of the adjustable arch support system may be used in any type of product as needed or otherwise as desired.

According to certain embodiments of the present invention, as shown in FIG. 1, an adjustable arch support system 1 may comprise an insole 2, an outer shell 4, an inner shell 6, and a track system 8.

The insole 2 may comprise a recessed area 20, which at least partially houses certain components of the adjustable arch support system 1. For example, in certain embodiments such as those illustrated in FIG. 1, the outer shell 4, the inner shell 6, and the track system 8 may be positioned within the recessed area 20. In other embodiments, only a subset of these components, none of these components, or any other additional components may be positioned within the recessed area 20.

In some embodiments, the insole does not comprise a recessed area 20. In further embodiments, the adjustable arch support system 1 is positioned underneath, or on top of, insole 2. In further embodiments, the adjustable arch system 1 is affixed to the surface of the insole, whether positioned underneath, or on top of, the insole 2. In further embodiments, the adjustable arch system 1 is affixed to insole 2.

According to some embodiments, the outer shell 4 and/or the inner shell 6 may have any suitable non-planar configuration. For example, the outer shell 4 and/or the inner shell 6 may have a cylindrical, elliptical, rounded, or otherwise non-planar shape. The two shells (4 and 6) may be configured to have complimentary mating shapes or different shapes. In general, the two shells need only have a single area of contact 22 between the two shells, although more areas of contact 22 may be provided as needed or as desired.

In general, the inner shell 6 is configured to provide additional support to the outer shell 4 in the area of contact 22. The inner shell 6 may be made of any suitably rigid material that prevents further deformation of the outer shell 4 due to pressure from a wearer's foot in the areas of contact 22. Examples of such materials comprising the inner shell 6 include aluminum, copper, carbon fiber, plastics, or any other type of metal with sufficient bending resistance that will prevent the inner shell 6 from further deformation or bending when pressure from the foot of the wearer is applied to the area of contact 22.

In an embodiment, the inner shell 6 is configured to allow the outer shell 4 to elastically bend or contour to the shape of the inner shell 6 in the area of contact 22 between the two shells 4, 6. In some embodiments, the outer shell 4 is formed of a material that is more flexible than the material used for the inner shell 6. For example, the outer shell 4 may be formed of plastics, natural or synthetic rubber, other elastomer materials, or other materials having a lower modulus of elasticity than the materials used to form the inner shell 6. As used herein, a modulus of elasticity is a quantity that measures an object's or substance's resistance to being deformed elastically when a stress is applied to it. The modulus of elasticity is defined as the slope of its stress-strain curve in the elastic deformation region. In other words, a stiffer material will have a higher modulus of elasticity. The modulus of elasticity may be referred to as Young's modulus and may be represented by the following formula:

$$E=\text{stress}/\text{strain}=\sigma/\varepsilon$$

The greater the value of young's modulus, the stiffer is the material. Units of Modulus of Elasticity/Young's modulus are: $Nm^{-2}$ or Pa.

$$\sigma(\text{stress})=F/A$$

Where σ is stress (in Newtons per square meter or, equivalently, Pascals), F is force (in Newtons, commonly abbreviated N), and A is the cross-sectional area of the sample.

$$\varepsilon(\text{strain})=\Delta L/L_0;\Delta L=L-L_0$$

Where $L_0$ is the original length of a bar being stretched, and L is its length after it has been stretched. ΔL is the extension of the bar, the difference between these two lengths.

TABLE 1

Young's Modulus of Selected Materials

| Material | GPa | Mpsi |
|---|---|---|
| Aluminum | 69 | 10 |
| Aromatic peptide nantubes | 19-27 | 2.76-3.92 |
| Beryllium | 287 | 41.6 |
| Brass | 100-125 | 14.5-18.1 |
| Bronze | 96-120 | 13.9-17.4 |
| Cooper | 117 | 17 |
| Carbyne | 32100 | 4660 |
| Diamond | 1050-1210 | 152-175 |
| Glass | 50-90 | 7.25-13.1 |
| Glass-reinforced polyester matrix | 17.2 | 2.49 |
| Graphene | 1050 | 152 |
| Low density polyethylene | 0.11-0.86 | 1.6-0.065 |
| Molybdenum | 329-330 | 47.7-47.9 |
| Nylon | 2.0-4 | 0.29-0.58 |
| Polypropylene | 1.5-2 | 0.22-0.29 |
| Polystyrene, foam | 0.0025-0.007 | 0.00036-0.00102 |
| Polystyrene, solid | 3-3.5 | 0.44-0.51 |
| PTFE (Teflon) | 0.5 | 0.075 |
| Rubber | 0.01-0.1 | 1.45-0.0145 |
| Steel (ASTM-A36) | 200 | 30 |
| Titanium | 110.3 | 16 |
| Tungsten | 400-410 | 58-59 |
| Wood (along grain) | 11 | 1.6 |
| Wroght iron | 190-210 | 27.6-30.5 |

The inner shell 6 and the outer shell 4 may be made from any suitable material, where the materials listed in Table 1 are non-limiting examples. The inner shell 6 and outer shell 4 may be made from the same material or from different materials. In some embodiments, the inner shell 6 and outer shell 4 are made from different materials. In some embodiments, the inner shell 6 and/or outer shell 4 are made from aluminum or rubber. In a further embodiment, inner shell 6 is made from aluminum and outer shell 4 is made from rubber. In some embodiments, the inner shell 6 and outer shell 4 are made from materials with a modulus of elasticity of less than about 400 GPa, less than about 300 GPa, less than about 200 GPa, less than about 100 GPa, less than about 50 GPa, less than about 25 GPa, less than about 10 GPa, or less than about 5 GPa. In some embodiments, the inner shell 6 and outer shell 4 are made from materials with a modulus of elasticity from about 0.0025 GPa to about 1 GPa, from about 1 GPa to about 5 GPa, from about 5 GPa to about 10 GPa, from about 10 GPa to about 25 GPa, from about 25 GPa to about 50 GPa, from about 50 GPa to about 100 GPa, from about 100 GPa to about 200 GPa, from about 200 GPa to about 300 GPa, from about 300 GPa to about 400 GPa, or greater than about 400 GPa.

The arch of the foot is routinely described as a high arch, medium (normal) arch, or a low (flat) arch. These different types of arches have differing shapes and overall space between the foot and base of the shoe. For example, the length of the arch will often vary, and is often proportional, to the overall length of the foot. Thus, the larger the foot, generally the larger the length of the arch, with all other variables being equal. Regardless of wearer, inner shell 6 and outer shell 4 may both be configured to account for this difference in shape and space. For example, in some embodiments, the shape may vary from semi-circular to oval, to circular. The lower surface of inner shell 6 may be flat and the upper surface rises in a curvilinear manner from a thin edge to a height of about 1.5 cm. In some embodiments, the inner shell 6 is about 5 cm long at its longest point, about 3 cm wide at its widest point, and about 1.5 cm tall at its tallest point, the inner shell 6 contacts outer shell 4 at a contact point, and the outer shell 4 is about 6 cm long at its longest point, about 4 cm wide at its widest point, and about 1.5 cm tall at its tallest point.

In some embodiments, the inner shell 6 and/or outer shell 4 has a length between about 1 cm and about 10 cm, between about 2 cm and about 9 cm, between about 3 cm and about 8 cm, between about 4 cm and about 7 cm, or between about 5 cm and 6 cm in length. In some embodiments, inner shell 6 and/or outer shell 4 has a length of about 1 cm, about 2 cm, about 3 cm, about 4 cm, about 5 cm, about 6 cm, about 7 cm, about 8 cm, about 9 cm, or about 10 cm. In some embodiments, inner shell 6 and/or outer shell 4 has a width between about 1 cm and about 5 cm, or between about 2 cm and about 4 cm. In some embodiments, inner shell 6 and/or outer shell 4 has a width of about 1 cm, about 2 cm, about 3 cm, about 4 cm, or about 5 cm. In some embodiments, inner shell 6 and/or outer shell 4 has a height of about 0.5 cm, about 1 cm, or about 1.5 cm. In some embodiments, inner shell 6 and/or outer shell 4 has a height between about 0.5 cm and about 1.5 cm. In some embodiments, inner shell 6 and/or outer shell 4 is a combination of any listed length, width, and height, where each dimension is conformed to the size and shape of the wearers arch. Outer shell 4 may have the same size or an alternate size from inner shell 6.

Outside of the area of contact 22, the outer shell 4 may have any suitable shape as described above. Furthermore, a gap 24 may be located between the outer shell 4 and the inner shell 6 outside of the area of contact 22. The gap 24 may provide additional space for the outer shell 4 to "flex" downward under pressure from a wearer's foot to provide a cushioning-type support. In the event that the "flex" area does not sufficiently support the wearer's arch, the position of the inner shell 6 may be adjusted so that the inner shell 6 closes the gap 24 at least partially, thereby providing less "flex" room in that location. Alternatively, the position of the inner shell 6 may be adjusted so that the inner shell 6 closes the gap 24 to create an area of contact 22, thereby minimizing or substantially eliminating any "flex" within the outer shell 4 in the area of contact 22.

Figure 2A:
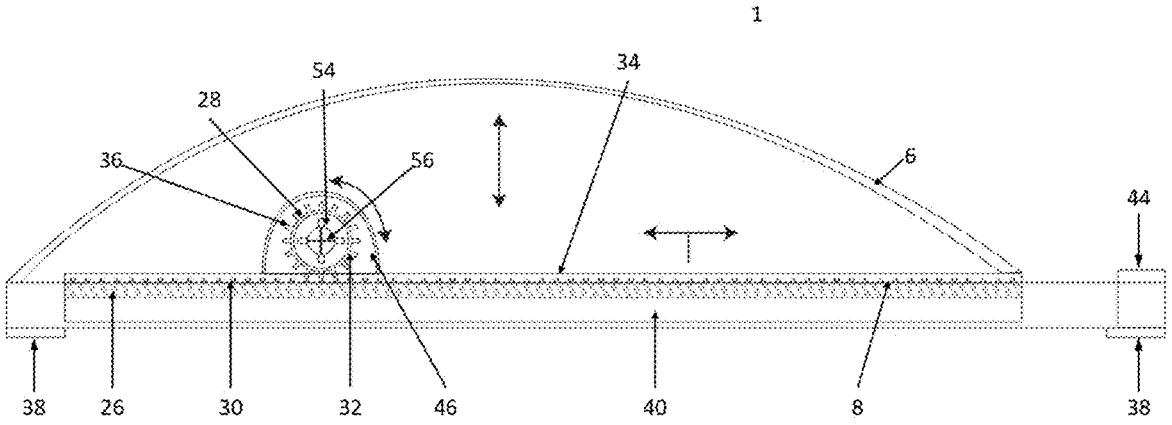
FIGS. 2A-2C show a cross-sectional side view of the adjustable arch support in accordance with an embodiment of the present invention.
Figure 2B:
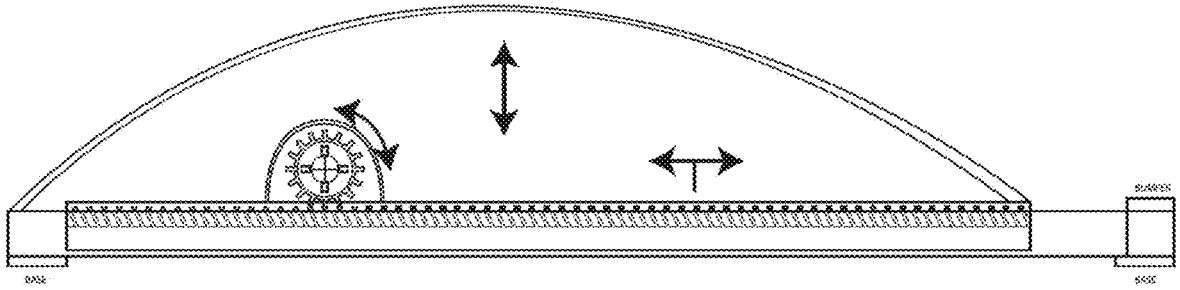
Figure 2C:
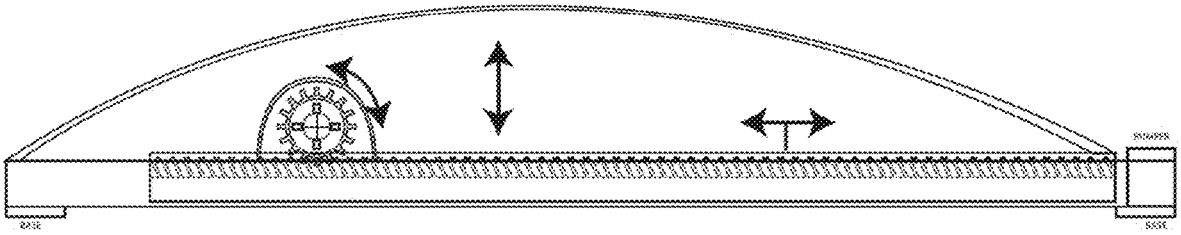

In order to adjust the position of the inner shell 6 relative to the outer shell 4, the inner shell 6 may be coupled to an adjustable portion of the track system 8. For example, the track system 8 may comprise a track 26 and a gear 28. In some embodiments, as illustrated in FIG. 2, the gear 28 is vertically and/or horizontally fixed in position, while the track 26 may only be vertically fixed in position. In other embodiments, the fixed and adjustable components may be arranged in any suitable configuration of position that creates the desired movement of the inner shell 6.

In some embodiments, the track 26 is translationally adjustable, while a central axis of the gear 28 is held stationary relative to a surface of the recessed area 20. A person of ordinary skill in the relevant art will understand that the central axis of gear 28 may be held stationary relative to other portions of the insole 2, the outer shell 4, or any other suitable location that allows the track 26 to adjust the position of the inner shell 6 relative to the gear 28.

In some embodiments, the track 26 may comprise a series of track teeth 30 that project upwardly from a planar surface 34 of the track 26. The gear 28 may likewise comprise a series of gear teeth 32 that project away from a circumferential surface 36 of the gear 28. In certain embodiments, the gear 28 is positioned over the track 26 in a manner that allows certain gear teeth 32 of the gear 28 to extend downwardly between certain track teeth 30 of the track 26. As the gear 28 rotates, the downwardly projecting gear teeth 32 press against adjacent track teeth 30 to translationally move the track 26 in the direction that the gear teeth 32 are traveling at the point of engagement. Thus, the gear 28 remains in a fixed position while the track 26 moves translationally, and the inner shell 6 moves translationally as well, with the track 26. The presence of the gear 28 with gear teeth 32 that fit into the track teeth 30 allows for both a large and small movement of the inner shell 6. For example, in FIG. 2 the gear 28 is depicted as having 16 teeth. The number of teeth in the gear 28 may be any number, as long as the gear teeth 28 continuously contact the track teeth 30, thus preventing unwanted movement of the inner shell 6. In some embodiments, gear 28 has 3, 4, 5, 6, 7, 8, 9, 10, 11, 12, 13, 14, 15, 16, 17, 18, 19, 20, 21, 22, 23, 24, 25, 26, 27, 28, 29, 30, 31, or 32 teeth. In a further embodiment, gear 28 has more than 32 teeth. In other embodiments, gear 28 has between 4 and 8 teeth, between 8 and 16 teeth, between 16 and 24 teeth, or between 24 and 32 teeth. The greater number of teeth allows for smaller increments of movement of inner shell 6. Thus, when the number of gear teeth 32 and track teeth 30 is large, a very large number of fine movements are possible for inner shell 6.

The gear 28 may be made from any one material or any number of materials. In an embodiment, gear 28 is made from a type of metal, a type of plastic, graphite, or any combination thereof. The material used to manufacture the gear is not particularly limited, but should be a material that is light in weight yet strong enough to withstand vibration and potential pressure that occurs during wear. For example, the gear needs to be strong enough to withstand the vibrational shock that occurs when a wearer is running.

Figure 3:
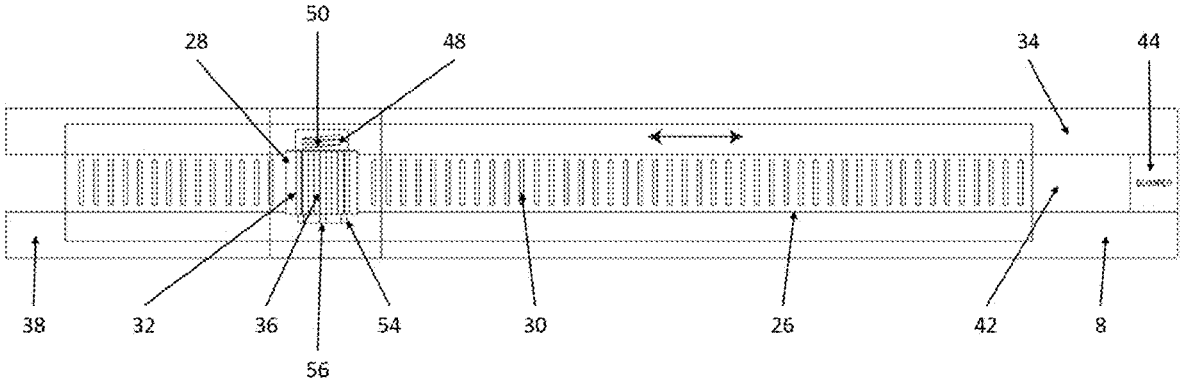
FIG. 3 shows a perspective view of the track system of the arch support in accordance with an embodiment of the present invention.
Figure 4:
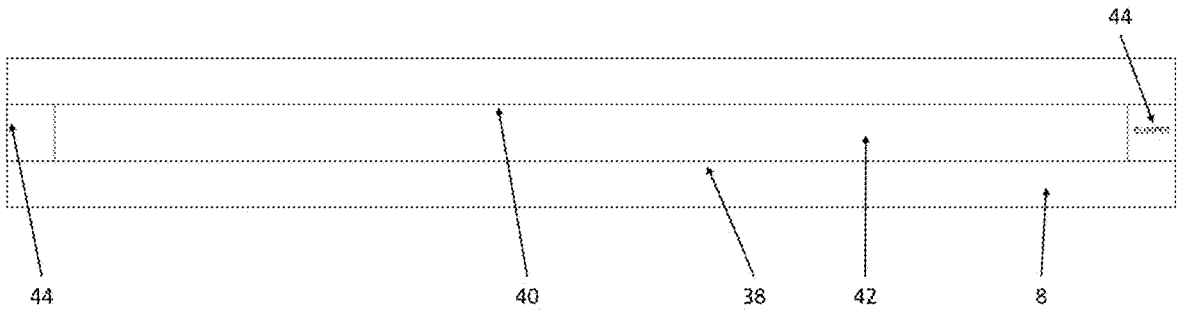
FIG. 4 shows a perspective view of the upper track system of the arch support in accordance with an embodiment of the present invention.
Figure 5:
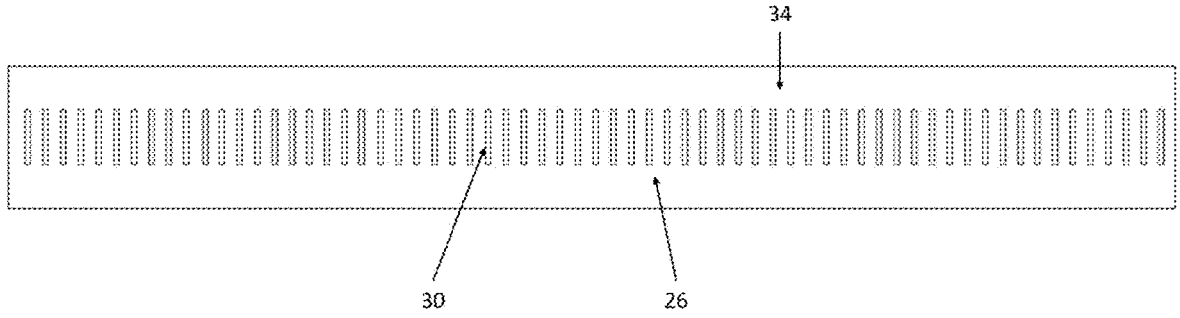
FIG. 5 shows a perspective view of the lower track system in accordance with an embodiment of the present invention.

To prevent unintended vertical movement of the inner shell 6, the track 26 may be translationally engaged with a base 38. For example, in an embodiment depicted in FIG. 3, the track 26 may be slidingly connected to a base 38. Examples of such sliding or translational connections may include a projection 40 from the bottom surface of the track 26 that is held within a slot or groove 42 within the base 38. Conversely, the base 38 may comprise a raised rail that is held within a slot or groove 42 on the track 26. Additional depictions of the track are represented in FIGS. 4 and 5. In an embodiment, the length of travel of the track 26 may be limited by bumpers 44 that are positioned at each end of the base 38. Base 38 may be attached to insole 2 to secure the adjustable arch support system. The attachment may be of any suitable type, such as by an adhesive or molding during manufacturing.

Figure 8:
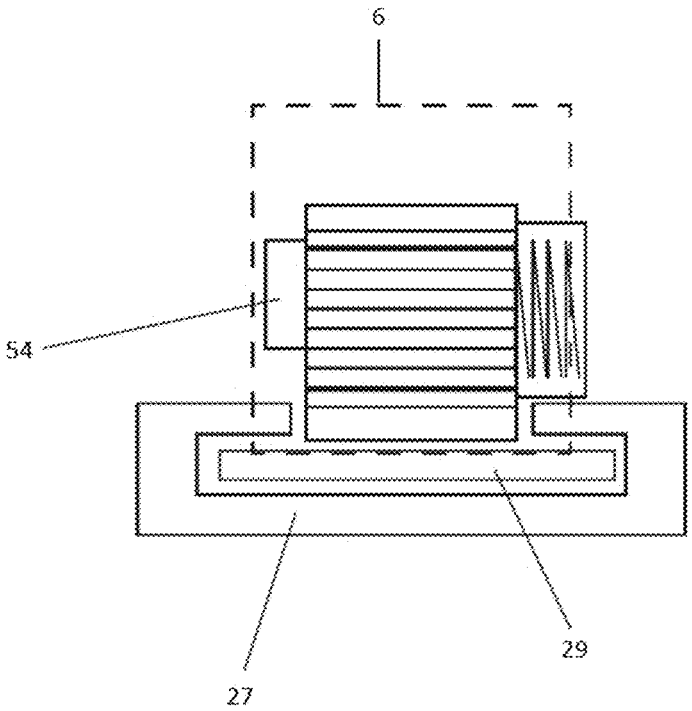
FIG. 8 shows a front view of the track system in accordance with an embodiment of the present invention.

In an embodiment, the track and adjustment system are as depicted in FIG. 8. For example, stationary track 27 is affixed to the insole while sliding track 29 is moveable. The track is moveable by turning peg 54 which moves gear 28. As depicted in FIG. 8, inner shell 6 surrounds the adjustment device.

As described above, the gear 28 may be rotated to adjust the position of the inner shell 6 along the track 26, which in turn adjusts the location of the area of contact 22 between the inner shell 6 and the outer shell 4. Access to the gear 28 may be provided via an opening 46 in the insole 2.

Figure 6:
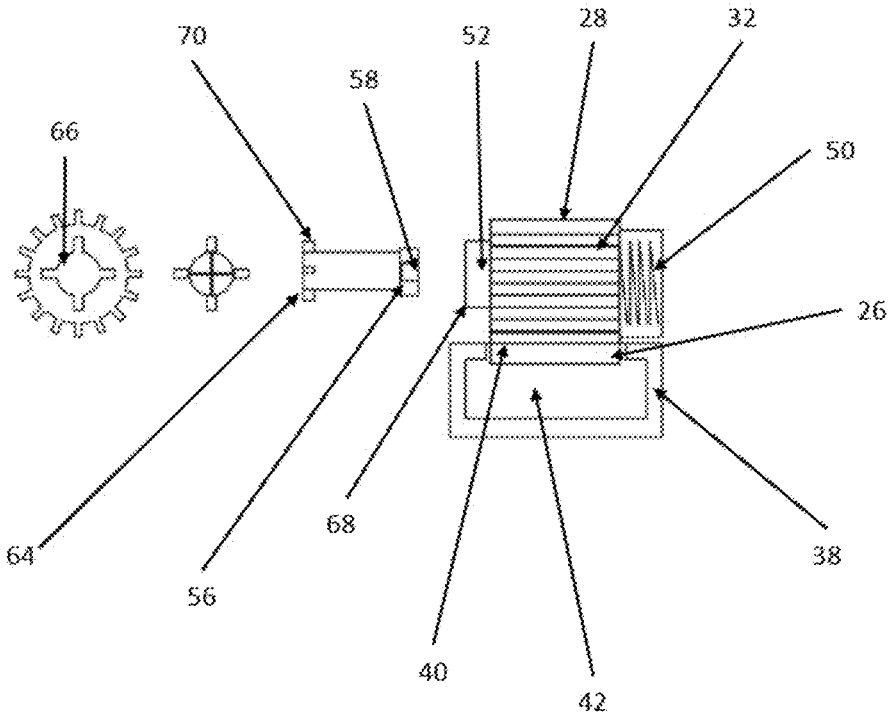
FIG. 6 shows the adjustment device in accordance with an embodiment of the present invention.
Figure 7:
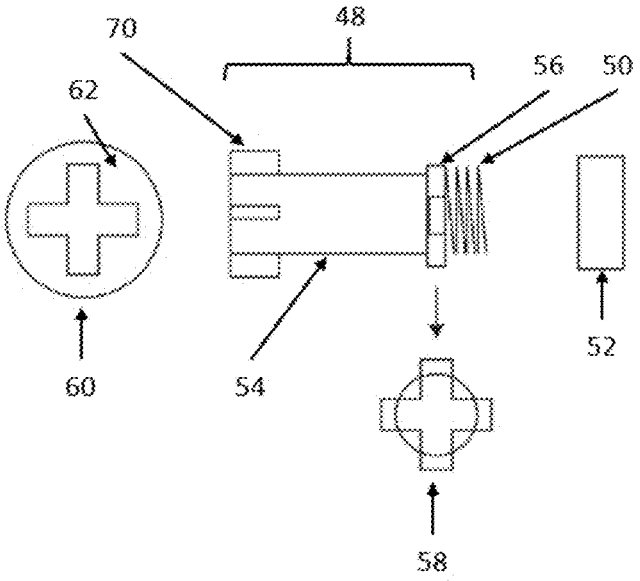
FIG. 7 shows the locking mechanism in accordance with an embodiment of the present invention.

Depictions of various embodiments of the adjustment system and components are represented in FIGS. 6 and 7. In an embodiment, in order to prevent inadvertent rotation of the gear 28, a spring-loaded device 48 may be used in conjunction with the gear 28. The spring-loaded device 48 includes a spring 50, which is positioned at least partially within an aperture 52 of the gear 28. A peg 54 is then positioned at least partially within the aperture 52 in front of the spring 50.

An inner end 56 of the peg 54 comprises an interlocking shape 58 that is configured to fit within a reciprocal interlocking shape 60 located within an inner surface 62 of the aperture 52 when the spring 50 is compressed. In its uncompressed state, the spring 50 pushes an outer end 70 of the peg 54 out of the aperture 52 so that the interlocking shapes 58 and 60 are disengaged from each other so as to prevent inadvertent rotation of the gear 28.

As a further safeguard against inadvertent rotation of the gear 28, a second interlocking shape 64 may also be configured to fit within a second reciprocal interlocking shape 66 located within an outer rim 68 of the aperture 52 when the spring 50 is uncompressed. When the two interlocking shapes 64 and 66 are engaged, the peg 54 is unable to rotate within the aperture 52.

Examples of such interlocking shapes 58, 60, 64, and 66 may include a cross-shaped series of projections around the outer end 70 of the peg 54, which engage with similar cross-shaped depressions in the outer rim 68 and in the inner surface 62, as shown in FIGS. 6 and 7. Any other suitable interlocking shape design may be used for controlling engagement between the outer end 70 of the peg 54 and the outer rim 68 and the inner surface 62.

In order to rotate the gear 28, the peg 54 must be pressed inwardly toward the spring 50 until the outer end 56 of the peg is no longer engaged with the outer rim 68 and is engaged with the inner surface 62.

The outer end 56 of the peg 54 further comprises a shape that can be engaged by a tool for (1) aligning and pressing the peg 54 inwardly to disengage from the outer rim 68 and engage with the inner surface 62, and to rotate the peg 54 thereby rotating the gear 28 and linearly displacing the inner shell 6.

Figure 9:
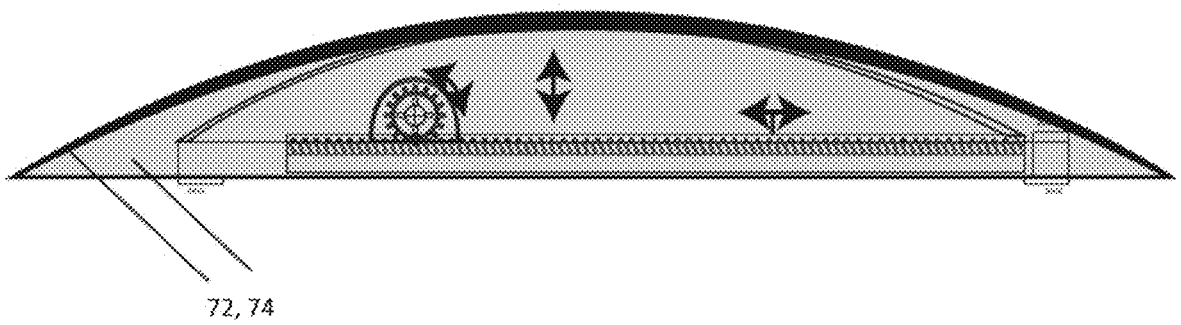
FIG. 9 shows a view where the arch support is made from specific materials.
Figure 10:
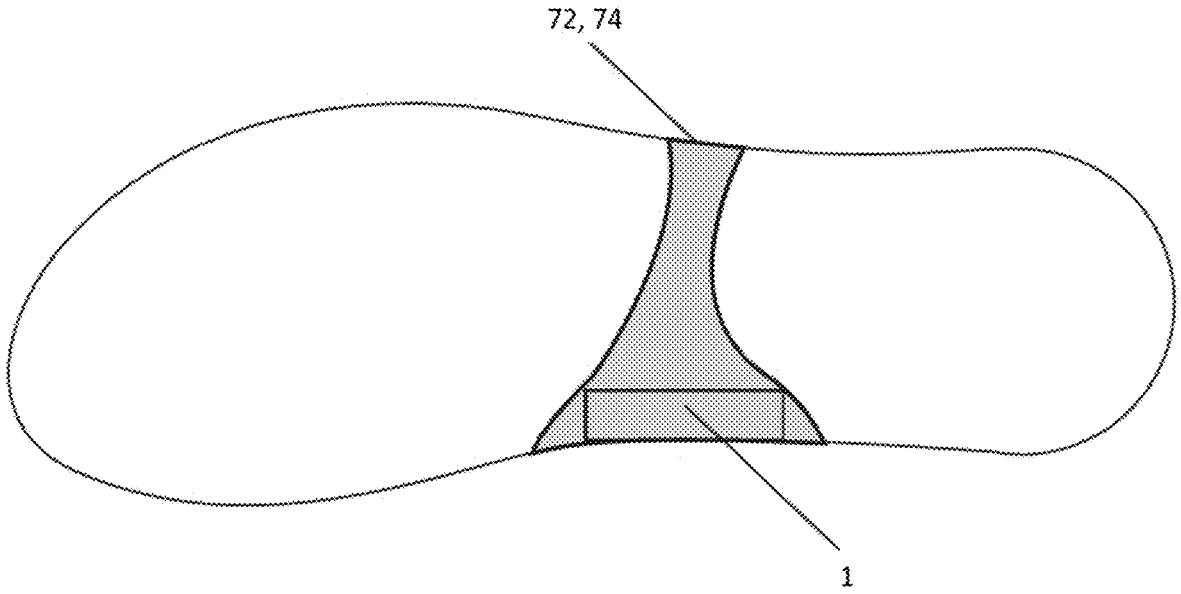
FIG. 10 shows a top-down view of the adjustable arch support.

In some embodiments of the subject matter described herein, the arch support system and its individual components are made of the same material. In other embodiments, different materials may be used for one or more portions of the arch support system. Without limitation, examples of materials from which portions or all of the arch support system may be formed include flexible weaved graphite, thermoplastic polyurethane (TPU), polyurethane (PU), acrylonitrile butadiene styrene (ABS), polylactic acid (PLA), polyamide (Nylon), glass filled polyamide, epoxy resins, silicone, nylon or Santoprene-brand thermoplastic vulcanizates (a thermoplastic elastomer), or similar materials. As depicted in FIG. 9, portions of the arch support system may be made from flexible weaved graphite 72 or durable plastic 74.

In some embodiments, the insole is further comprised of additional gel inserts or similar-type cushioning materials that are located at the ball of the foot and in the heel cup areas for further cushioning within the insole of the shoe.

Methods of Making and Using the Adjustable Arch Support System

The subject matter further described herein also relates to methods for making the adjustable arch support system. The actual method for fabricating pieces of the system, or the entire system, are not particularly limited. For example, portions or all of the components in the arch support may be fabricated using 3D printing, laser sintering, or other rapid prototyping techniques in which different materials are used for different portions of the arch support system being fabricated. In some embodiments, the adjustable arch support system can be obtained from a manufacturer, distributor, wholesaler, or another entity.

Arch supports according to some embodiments can be fabricated for any of a wide variety of shoe sizes. The overall length of an arch support system according to various embodiments may vary based on, e.g., the size shoe for which the arch support is intended. In some embodiments, an arch support system may have an overall length from forward-most point to rear-most point of between about 2 cm and about 10 cm. In some embodiments, the arch support system is fabricated to generally conform to a human being's foot arch in various arch heights and lengths.

The arch support insert is available in many different sizes to match a wearer's mid-foot arch size. Among the many different sizes available, the insert will function to support a low arch, medium arch, or high-arch. A wearer will simply select the arch support system size that best fits their individual foot. In one embodiment of the presently disclosed subject matter, a size, shape, positioning, and firmness of the arch support is selected in accordance with the characteristics of the wearer.

For example, a manufacturer of the adjustable arch support system can input into a computing device one or more physical characteristics of the foot (e.g., the contour of the foot, type of arch, length of arch, etc.). Alternatively, a 2D or 3D scan of the user's foot can be taken using a scanning device (e.g., one or more cameras, depth sensors, ultrasonic transducers, etc.), and the scanning device can provide information associated with the physical characteristics of the user's foot to the computing device. The computing device can then adjust at least a portion of a CAD model, schematic, or rendering of the adjustable arch support system, inner shell 6, and/or outer shell 4 to account for the physical characteristics of the user's foot. For example, the computing device can automatically adjust the dimensions of the length, width, and/or height to account for a curvature in the user's foot. The adjustable arch support system, inner shell 6, and/or outer shell 4 can then be produced according to the updated CAD model.

In a similar manner, the insole 2 is sized to fit into a wearers shoe. The insole may be modified by length or width to fit any shoe size. The insole 2 may be of varying thickness where the thickness is the same throughout the entire insole, or parts of the insole are thicker than others.

The subject matter disclosed herein further relates to a method of customizing the adjustable arch support in a shoe where the method comprising the steps of: selecting an adjustable arch support size and position that closely matches a wearer's mid-foot arch, preparing the adjustable arch support, and fastening the adjustable arch support into the wearer's shoe. In an embodiment, the adjustable arch support is incorporated into an insole, thus creating the adjustable arch support system, prior to the insole-arch support system being placed into the wearer's shoe.

Although the above steps are described for illustrative purposes, other embodiments can include the same or different steps performed in the same or different order.

The subject matter disclosed herein also comprises methods for using the adjustable arch support system. For example, as disclosed herein in an embodiment is a method of using the adjustable arch support system, the method comprising adjusting a position of the inner shell relative to the outer shell until the inner shell contacts the outer shell at a desired location.

As in any above embodiment, a method wherein adjusting the position of the inner shell relative to the outer shell comprises rotating a gear coupled to a track.

As in any above embodiment, a method wherein rotating the gear creates a translational movement of the inner shell.

As in any above embodiment, a method wherein rotating the gear further comprises pressing a peg inward until the peg engages with the gear.

As in any above embodiment, a method wherein rotating the gear further comprises pressing a peg inward until the peg disengages from an inner surface of an aperture.

Advantages of Embodiments

Embodiments of the presently disclosed subject matter provide numerous advantages. For example, some embodiments enable the user to adjust the arch support while the support is in the shoe. Other advantages include a high degree of customization, ability to use the system in a number of different shoes, and a reduction in the overall expense to the wearer. Still further advantages arise from the ability of the disclosed system to be adjusted in very fine increments, thus enabling a very fine degree of customization.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below. It is intended that the specification and examples be considered as exemplary only, with a true scope and spirit of the invention being indicated by the following claims.

That which is claimed is:

1. An adjustable arch support system comprising
an insole; an outer shell positioned within the insole;
an inner shell positioned below the outer shell; and
an adjustment system comprising a gear, wherein the inner shell is attached to the adjustment system and the adjustment system is configured to control an area of contact between the inner shell and the outer shell;
the adjustment system further comprises a track that is at least translationally mobile relative to the central axis of the gear, and rotation of the gear is configured to create a translational movement of the track; and
the adjustment system further comprises an interlocking peg that engages with the gear when the interlocking peg is pressed toward the gear, and the interlocking peg disengages from the gear when the interlocking peg is not pressed toward the gear.

2. The adjustable arch support system of claim 1, wherein the outer shell is conformable to a shape of the inner shell at least in the area of contact.

3. The adjustable arch support system of claim 1, wherein the gear has a central axis that is held stationary within the inner sole.

4. The adjustable arch support system of claim 1, wherein the inner shell is formed of a first material and the outer shell is formed of a second material, wherein the first material has a higher modulus of elasticity than the second material.

5. The adjustable arch support system of claim 4, wherein the first material has a modulus of elasticity of less than about 200 GPa and the second material has a modulus of elasticity of less than about 100 GPa.

6. The adjustable arch support system of claim 1, wherein the inner shell has a length between about 3 cm and about 8 cm, a width between about 1 cm and about 5 cm, and a height between about 0.5 cm and about 1.5 cm.

7. An adjustable arch support system comprising an outer shell, an inner shell positioned below the inner shell, and an adjustment system positioned inside the inner shell, wherein the adjustment system comprises a gear, a peg, an aperture, and a spring, wherein the peg comprises an interlocking shape that is configured to fit within a reciprocal interlocking shape located within an inner surface of the aperture, and the inner shell is coupled to a track; and the adjustment system is configured to control an area of contact between the inner shell and the outer shell.

8. The adjustable arch support system of claim 7, wherein the gear has between 4 and 16 teeth.

9. The adjustable arch support system of claim 7, the adjustment system has a second interlocking shape and a second reciprocal interlocking shape.

10. The adjustable arch support system of claim 7, wherein the gear is rotatable when the peg is pressed into the gear to engage corresponding interlocking shapes between the peg and the gear.

11. The adjustable arch support system of claim 7, wherein the track is translationally coupled to the gear.

12. The adjustable arch support system of claim 7, wherein the inner shell is composed of a material with a modulus of elasticity less than 200 GPa.

* * * * *